US008053989B2

(12) United States Patent
Sakamoto et al.

(10) Patent No.: US 8,053,989 B2
(45) Date of Patent: Nov. 8, 2011

(54) PLASMA DISPLAY PANEL

(75) Inventors: Koyo Sakamoto, Osaka (JP); Akira Shiokawa, Osaka (JP); Kaname Mizokami, Kyoto (JP); Shinichiro Ishino, Osaka (JP); Hiroyuki Kado, Osaka (JP); Yoshinao Ooe, Kyoto (JP); Hideji Kawarazaki, Osaka (JP); Kazuo Uetani, Osaka (JP)

(73) Assignee: Panasonic Corporation, Osaka (JP)

( * ) Notice: Subject to any disclaimer, the term of this patent is extended or adjusted under 35 U.S.C. 154(b) by 350 days.

(21) Appl. No.: 12/524,092

(22) PCT Filed: Feb. 25, 2009

(86) PCT No.: PCT/JP2009/000824

§ 371 (c)(1),
(2), (4) Date: Jul. 22, 2009

(87) PCT Pub. No.: WO2009/110195

PCT Pub. Date: Sep. 11, 2009

(65) Prior Publication Data

US 2011/0210663 A1 Sep. 1, 2011

(30) Foreign Application Priority Data

Mar. 3, 2008 (JP) ..... 2008-051778

(51) Int. Cl.
*H01J 17/49* (2006.01)

(52) U.S. Cl. ..... 313/586; 313/582

(58) Field of Classification Search ..... 313/582, 313/584, 586, 587

See application file for complete search history.

(56) References Cited

U.S. PATENT DOCUMENTS

| | | | |
|---|---|---|---|
| 7,759,868 | B2 | 7/2010 | Naoi et al. |
| 2006/0284559 | A1 | 12/2006 | Naoi et al. |
| 2008/0049382 | A1 | 2/2008 | Kasahara |
| 2008/0150428 | A1 | 6/2008 | Uriu et al. |
| 2009/0140652 | A1 | 6/2009 | Fukui et al. |
| 2009/0146566 | A1 | 6/2009 | Fukui et al. |
| 2010/0156292 | A1 | 6/2010 | Kawase et al. |

(Continued)

FOREIGN PATENT DOCUMENTS

| | | |
|---|---|---|
| EP | 1 659 605 | 11/2005 |

(Continued)

OTHER PUBLICATIONS

European Extended Search Report issued Mar. 15, 2011 in European Application No. 09 71 8035.

(Continued)

*Primary Examiner* — Vip Patel
(74) *Attorney, Agent, or Firm* — Wenderoth, Lind & Ponack, L.L.P.

(57) ABSTRACT

A plasma display panel includes a front panel including a glass substrate, a display electrode formed thereon, a dielectric layer formed so as to cover the display electrode, and a protective layer formed on the dielectric layer; and a rear panel disposed facing the front panel so that discharge space is formed and including an address electrode formed in a direction intersecting the display electrode, and a barrier rib for partitioning the discharge space. The dielectric layer of the front panel contains bismuth oxide and calcium oxide without containing lead, and does not contain lead. The protective layer on the dielectric layer is formed by forming a base film on the second dielectric layer and attaching a plurality of crystal particles made of metal oxide to the base film so as to be distributed over an entire surface of the base film.

3 Claims, 5 Drawing Sheets

U.S. PATENT DOCUMENTS

2010/0213818 A1 8/2010 Naoi et al.

FOREIGN PATENT DOCUMENTS

| | | |
|---|---|---|
| EP | 1 806 762 | 7/2007 |
| EP | 1 933 353 | 6/2008 |
| EP | 2 099 052 | 9/2009 |
| EP | 2 214 193 | 8/2010 |
| JP | 2003-128430 | 5/2003 |
| JP | 2006-147417 | 6/2006 |
| JP | 2007-48733 | 2/2007 |
| JP | 2007-128858 | 5/2007 |
| JP | 2008-21660 | 1/2008 |
| KR | 10-2006-0056869 | 5/2006 |
| KR | 10-2007-0099020 | 10/2007 |

OTHER PUBLICATIONS

International Search Report issued Mar. 24, 2009 in the International (PCT) Application No. PCT/JP2009/000824.

PLASMA DISPLAY PANEL

THIS APPLICATION IS A U.S. NATIONAL PHASE APPLICATION OF PCT INTERNATIONAL APPLICATION PCT/JP2009/000824.

TECHNICAL FIELD

The present invention relates to a plasma display panel used in a display device, and the like.

BACKGROUND ART

Since a plasma display panel (hereinafter, referred to as a "PDP") can realize high definition and a large screen, 65-inch class televisions are commercialized. Recently, PDPs have been applied to high-definition television in which the number of scan lines is twice or more than that of a conventional NTSC method. Meanwhile, from the viewpoint of environmental problems, PDPs without containing a lead component have been demanded.

A PDP basically includes a front panel and a rear panel. The front panel includes a glass substrate of sodium borosilicate glass produced by a float process; display electrodes each composed of striped transparent electrode and bus electrode formed on one principal surface of the glass substrate; a dielectric layer covering the display electrodes and functioning as a capacitor; and a protective layer made of magnesium oxide (MgO) formed on the dielectric layer. On the other hand, the rear panel includes a glass substrate; striped address electrodes formed on one principal surface of the glass substrate; a base dielectric layer covering the address electrodes; barrier ribs formed on the base dielectric layer; and phosphor layers formed between the barrier ribs and emitting red, green and blue light, respectively.

The front panel and the rear panel are hermetically sealed so that the surfaces having electrodes face each other. Discharge gas of Ne—Xe is filled in discharge space partitioned by the barrier ribs at a pressure of 400 Torr to 600 Torr. The PDP realizes a color image display by selectively applying a video signal voltage to the display electrode so as to generate electric discharge, thus exciting the phosphor layer of each color with ultraviolet rays generated by the electric discharge so as to emit red, green and blue light (see patent document 1).

In such PDPs, the role of the protective layer formed on the dielectric layer of the front panel includes protecting the dielectric layer from ion bombardment due to electric discharge, emitting initial electrons so as to generate address discharge, and the like. Protecting the dielectric layer from ion bombardment is an important role for preventing a discharge voltage from increasing. Furthermore, emitting initial electrons so as to generate address discharge is an important role for preventing address discharge error that may cause flicker of an image.

In order to reduce flicker of an image by increasing the number of initial electrons emitted from the protective layer, an attempt to add Si and Al into MgO has been made for instance.

Recently, televisions have realized higher definition. In the market, high-definition (1920×1080 pixels: progressive display) PDPs having low cost, low power consumption and high brightness have been demanded. Since electron emission performance of a protective layer determines an image quality of a PDP, it is very important to control the electron emission performance.

In PDPs, an attempt to improve the electron emission performance by mixing impurities in a protective layer has been made. However, when the electron emission performance is improved by mixing impurities in the protective layer, electric charges accumulate on the surface of the protective layer, thus increasing a damping factor, that is, reducing electric charges to be used as a memory function with the passage of time. Therefore, in order to suppress this, it is necessary to take measures, for example, to increase a voltage to be applied. Thus, a protective layer should have two conflicting properties: having high electron emission performance, and having high electric charge retention performance of reducing damping factor of electric charges as a memory function.

[Patent document 1] Japanese Patent Unexamined Publication No. 2003-128430

SUMMARY OF THE INVENTION

A PDP of the present invention includes a front panel including a substrate, a display electrode formed on the substrate, a dielectric layer formed so as to cover the display electrode, and a protective layer formed on the dielectric layer; and a rear panel being disposed facing the front panel so that discharge space is formed and including an address electrode formed in a direction intersecting the display electrode, and a barrier rib for partitioning the discharge space. The dielectric layer of the front panel contains bismuth oxide and calcium oxide without containing lead. The protective layer is formed by forming a base film on the dielectric layer and attaching a plurality of crystal particles made of metal oxide to the base film so that the crystal particles are distributed over an entire surface of the base film.

With such a configuration, a PDP having improved electron emission performance and electric charge retention performance and being capable of achieving a high image quality, low cost, and low voltage is provided. Thus, a PDP with low electric power consumption and with high-definition and high-brightness display performance can be realized.

Furthermore, with a configuration in which a base film is formed on a dielectric layer containing bismuth oxide and calcium oxide without containing lead and a plurality of crystal particles made of metal oxide are attached to the base film so as to be distributed over the entire surface of the base film, the property can be improved without using materials affecting the environment.

REFERENCE MARKS IN THE DRAWINGS

Figure 1:
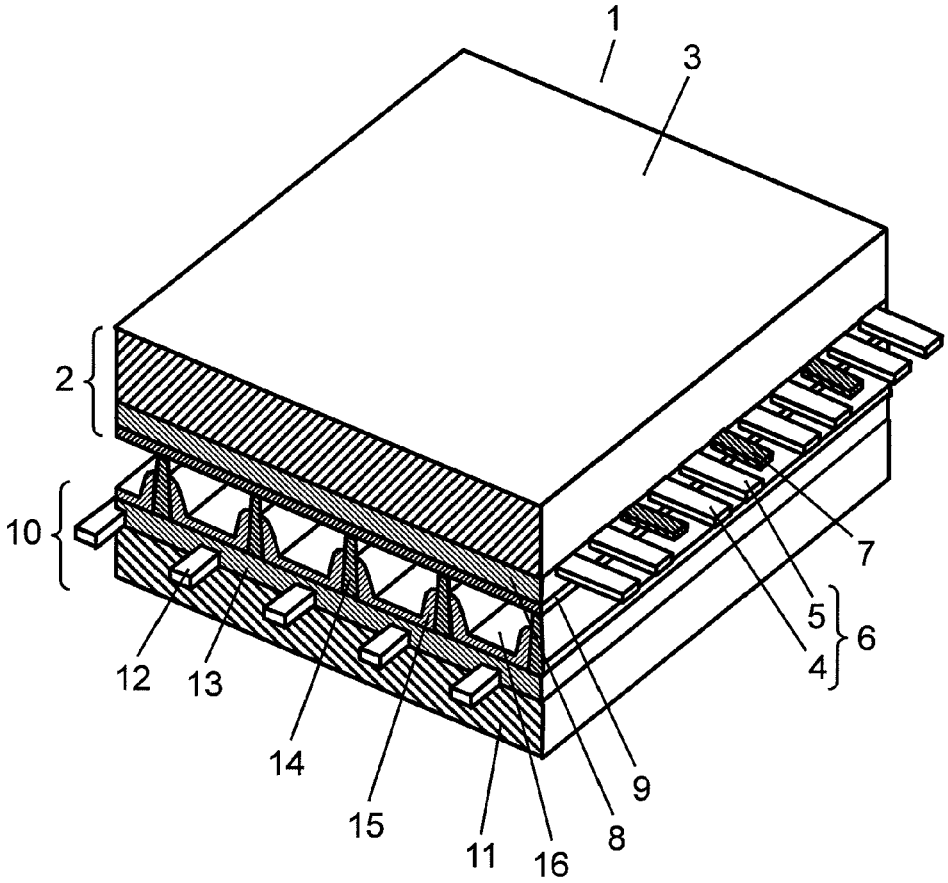
FIG. 1 is a perspective view showing a structure of a PDP in accordance with an exemplary embodiment of the present invention.

1 PDP
2 front panel
3 front glass substrate
4 scan electrode
4*a*, 5*a* transparent electrode
4*b*, 5*b* metal bus electrode
5 sustain electrode
6 display electrode
7 black stripe (light blocking layer)
8 dielectric layer
9 protective layer
10 rear panel
11 rear glass substrate
12 address electrode
13 base dielectric layer
14 barrier rib
15 phosphor layer
16 discharge space
81 first dielectric layer
82 second dielectric layer
91 base film
92 aggregated particles
92*a* crystal particle

DETAILED DESCRIPTION OF THE PREFERRED EMBODIMENT

Hereinafter, a PDP in accordance with an exemplary embodiment of the present invention is described with reference to drawings.

Exemplary Embodiment

FIG. 1 is a perspective view showing a structure of a PDP in accordance with the exemplary embodiment of the present invention. The basic structure of the PDP is the same as that of a general AC surface-discharge type PDP. As shown in FIG. 1, PDP 1 includes front panel 2 including front glass substrate 3 and the like, and rear panel 10 including rear glass substrate 11 and the like. Front panel 2 and rear panel 10 are disposed facing each other. The outer peripheries of PDP1 are hermetically sealed together with a sealing material made of, for example, a glass frit. In discharge space 16 inside the sealed PDP 1, discharge gas such as Ne and Xe is filled at a pressure of 400 Torr to 600 Torr.

On front glass substrate 3 of front panel 2, a plurality of display electrodes 6 each composed of a pair of band-like scan electrode 4 and sustain electrode 5 and black stripes (light blocking layers) 7 are disposed in parallel to each other. On glass substrate 3, dielectric layer 8 functioning as a capacitor is formed so as to cover display electrodes 6 and blocking layers 7. Furthermore, protective layer 9 made of, for example, magnesium oxide (MgO) is formed on the surface of dielectric layer 8.

Furthermore, on rear glass substrate 11 of rear panel 10, a plurality of band-like address electrodes 12 are disposed in parallel to each other in the direction orthogonal to scan electrodes 4 and sustain electrodes 5 of front panel 2, and base dielectric layer 13 covers address electrodes 12. In addition, barrier ribs 14 with a predetermined height for partitioning discharge space 16 are formed between address electrodes 12 on base dielectric layer 13. In grooves between barrier ribs 14, every address electrode 12, phosphor layers 15 emitting red, green and blue light by ultraviolet rays are sequentially formed by coating. Discharge cells are formed in positions in which scan electrodes 4 and sustain electrodes 5 intersect address electrodes 12. The discharge cells having red, green and blue phosphor layers 15 arranged in the direction of display electrode 6 function as pixels for color display.

Figure 2:
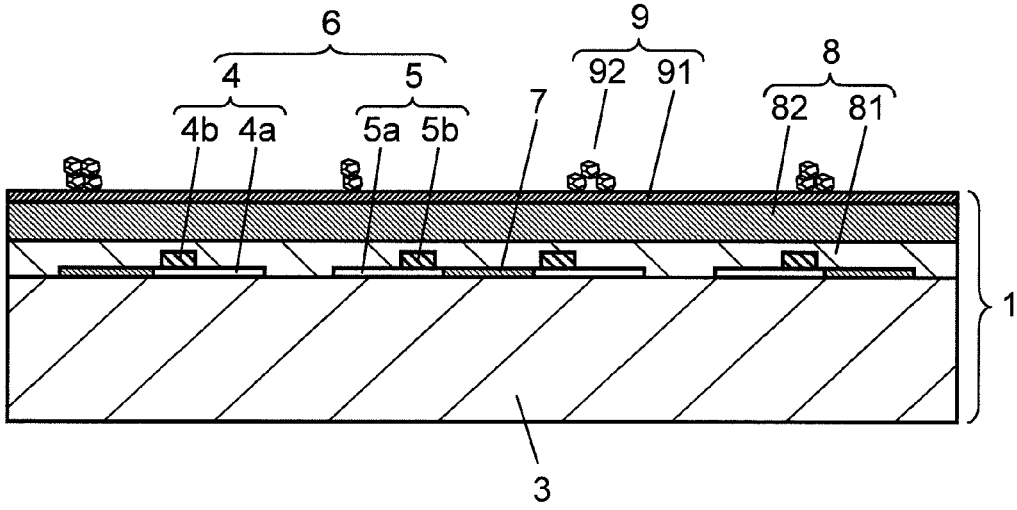
FIG. 2 is a sectional view showing a configuration of a front panel of the PDP.

FIG. 2 is a sectional view showing a configuration of front panel 2 of PDP 1 in accordance with the exemplary embodiment of the present invention. FIG. 2 is shown turned upside down with respect to FIG. 1. As shown in FIG. 2, display electrodes 6 each composed of scan electrode 4 and sustain electrode 5 and light blocking layers 7 are pattern-formed on front glass substrate 3 produced by, for example, a float method. Scan electrode 4 and sustain electrode 5 include transparent electrodes 4*a* and 5*a* made of indium tin oxide (ITO), tin oxide ($SnO_2$), or the like, and metal bus electrodes 4*b* and 5*b* formed on transparent electrodes 4*a* and 5*a*, respectively. Metal bus electrodes 4*b* and 5*b* are used for the purpose of providing the conductivity in the longitudinal direction of transparent electrodes 4*a* and 5*a* and formed of a conductive material containing a silver (Ag) material as a main component.

Dielectric layer 8 includes at least two layers, that is, first dielectric layer 81 and second dielectric layer 82. First dielectric layer 81 is provided for covering transparent electrodes 4*a* and 5*a*, metal bus electrodes 4*b* and 5*b* and light blocking layers 7 formed on front glass substrate 3. Second dielectric layer 82 is formed on first dielectric layer 81. In addition, protective layer 9 is formed on second dielectric layer 82. Protective layer 9 includes base film 91 formed on dielectric layer 8 and aggregated particles 92 attached to base film 91.

Next, a method of manufacturing a PDP is described. Firstly, scan electrodes 4, sustain electrodes 5 and light blocking layers 7 are formed on front glass substrate 3. Transparent electrodes 4*a* and 5*a* and metal bus electrodes 4*b* and 5*b* thereof are formed by patterning with the use of, for example, a photolithography method. Transparent electrodes 4*a* and 5*a* are formed by, for example, a thin film process. Metal bus electrodes 4*b* and 5*b* are formed by firing a paste containing a silver (Ag) material at a predetermined temperature to be solidified. Furthermore, light blocking layer 7 is similarly formed by a method of screen printing a paste containing a black pigment, or a method of forming a black pigment on the entire surface of the glass substrate, then carrying out patterning by a photolithography method, and firing thereof.

Next, a dielectric paste is coated on front glass substrate 3 by, for example, a die coating method so as to cover scan electrodes 4, sustain electrodes 5 and light blocking layer 7, thus forming a dielectric paste layer (dielectric material layer). Since the dielectric paste is coated and then stood still for a predetermined time, the surface of the coated dielectric paste is leveled and flattened. Thereafter, the dielectric paste layer is fired and solidified, thereby forming dielectric layer 8 that covers scan electrode 4, sustain electrode 5 and light blocking layer 7. The dielectric paste is a coating material including a dielectric material such as glass powder, a binder and a solvent.

Next, protective layer 9 made of magnesium oxide (MgO) is formed on dielectric layer 8 by a vacuum deposition method. In the above-mentioned steps, predetermined components, that is, scan electrode 4, sustain electrode 5, light blocking layer 7, dielectric layer 8, and protective layer 9 are formed on front glass substrate 3. Thus, front panel 2 is completed.

On the other hand, rear panel 10 is formed as follows. Firstly, a material layer as a component of address electrode 12 is formed on rear glass substrate 11 by, for example, a method of screen-printing a paste containing a silver (Ag) material, or a method of forming a metal film on the entire surface and then patterning it by a photolithography method. Then, the material layer is fired at a predetermined temperature. Thus, address electrode 12 is formed.

Next, on rear glass substrate 11 on which address electrode 12 is formed, a dielectric paste is coated so as to cover address electrodes 12 by, for example, a die coating method. Thus, a dielectric paste layer is formed. Thereafter, by firing the dielectric paste layer, base dielectric layer 13 is formed. Note here that the dielectric paste is a coating material including a dielectric material such as glass powder, a binder, and a solvent.

Next, by coating a barrier rib formation paste containing a material for the barrier rib on base dielectric layer 13 and patterning it into a predetermined shape, a barrier rib material layer is formed. Then, the barrier rib material layer is fired so as to form barrier ribs 14. Herein, a method of patterning the barrier rib formation paste coated on base dielectric layer 13 may include a photolithography method and a sand-blast method. Next, a phosphor paste containing a phosphor material is coated on base dielectric layer 13 between neighboring barrier ribs 14 and on the side surfaces of barrier ribs 14 and fired. Thereby, phosphor layer 15 is formed. With the above-mentioned steps, rear panel 10 including rear glass substrate 11 provided with predetermined component members is completed.

Front panel 2 and rear panel 10, which include predetermined component members in this way, are disposed facing each other so that scan electrodes 4 and address electrodes 12 are disposed orthogonal to each other, and sealed together at the peripheries thereof with a glass frit. Discharge gas including, for example, Ne and Xe, is filled in discharge space 16. Thus, PDP 1 is completed.

Herein, first dielectric layer 81 and second dielectric layer 82 forming dielectric layer 8 of front panel 2 are described in detail. A dielectric material of first dielectric layer 81 includes the following material compositions: 20 wt. % to 40 wt. % of bismuth oxide ($Bi_2O_3$); 0.5 wt. % to 12 wt. % of at least one selected from calcium oxide (CaO), strontium oxide (SrO) and barium oxide (BaO); and 0.1 wt. % to 7 wt. % of at least one selected from molybdenum oxide ($MoO_3$), tungsten oxide ($WO_3$), cerium oxide ($CeO_2$), and manganese oxide ($MnO_2$).

Instead of molybdenum oxide ($MoO_3$), tungsten oxide ($WO_3$), cerium oxide ($CeO_2$) and manganese oxide ($MnO_2$), 0.1 wt. % to 7 wt. % of at least one selected from copper oxide (CuO), chromium oxide ($Cr_2O_3$), cobalt oxide ($CO_2O_3$), vanadium oxide ($V_2O_7$) and antimony oxide ($Sb_2O_3$) may be included.

Furthermore, as components other than the above-mentioned components, material compositions that do not include a lead component, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$) may be included. The contents of these material compositions are not particularly limited.

The dielectric materials including these composition components are ground to an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder components are well kneaded by using a three-roller to form a paste for the first dielectric layer to be used in die coating or printing.

The binder component is ethyl cellulose, or terpineol containing 1 wt % to 20 wt % of acrylic resin, or butyl carbitol acetate. Furthermore, in the paste, if necessary, at least one or more of dioctyl phthalate, dibutyl phthalate, triphenyl phosphate and tributyl phosphate may be added as a plasticizer; and at least one or more of glycerol monooleate, sorbitan sesquioleate, Homogenol (Kao Corporation), an alkylallyl phosphate, and the like, may be added as a dispersing agent, so that the printing property may be improved.

Next, this first dielectric layer paste is printed on front glass substrate 3 by a die coating method or a screen printing method so as to cover display electrodes 6 and dried, followed by firing at a temperature of 575° C. to 590° C., that is, a slightly higher temperature than the softening point of the dielectric material.

Next, second dielectric layer 82 is described. A dielectric material of second dielectric layer 82 includes 11 wt. % to 20 wt. % of bismuth oxide ($Bi_2O_3$) and the content of bismuth oxide of the second dielectric layer 82 is made to be smaller than the content of bismuth oxide of the first dielectric layer 81. Furthermore, the dielectric material includes 1.6 wt. % to 21 wt. % of at least one selected from calcium oxide (CaO), strontium oxide (SrO), and barium oxide (BaO); and 0.1 wt. % to 7 wt. % of at least one selected from molybdenum oxide ($MoO_3$), tungsten oxide ($WO_3$), and cerium oxide ($CeO_2$).

Instead of molybdenum oxide ($MoO_3$), tungsten oxide ($WO_3$) and cerium oxide ($CeO_2$), 0.1 wt. % to 7 wt. % of at least one selected from copper oxide (CuO), chromium oxide ($Cr_2O_3$), cobalt oxide ($Co_2O_3$), vanadium oxide ($V_2O_7$), antimony oxide ($Sb_2O_3$) and manganese oxide ($MnO_2$) may be included.

Furthermore, as components other than the above-mentioned components, material compositions that do not include a lead component, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$) may be included. The contents of these material compositions are not particularly limited.

The dielectric materials including these composition components are ground to an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder components are well kneaded by using a three-roller to form a paste for the second dielectric layer to be used in die coating or printing. The binder component is ethyl cellulose, or terpineol containing 1 wt % to 20 wt % of acrylic resin, or butyl carbitol acetate. Furthermore, in the paste, if necessary, dioctyl phthalate, dibutyl phthalate, triphenyl phosphate and tributyl phosphate may be added as a plasticizer; and glycerol monooleate, sorbitan sesquioleate, Homogenol (Kao Corporation), an alkylallyl phosphate, and the like, may be added as a dispersing agent so that the printing property may be improved.

Next, this second dielectric layer paste is printed on first dielectric layer 81 by a screen printing method or a die coating method and dried, followed by firing at a temperature of 550° C. to 590° C., that is, a slightly higher temperature than the softening point of the dielectric material.

Note here that it is preferable that the film thickness of dielectric layer 8 in total of first dielectric layer 81 and second dielectric layer 82 is not more than 41 μm in order to secure the visible light transmittance. In first dielectric layer 81, in order to suppress the reaction between metal bus electrodes 4*b* and 5*b* and silver (Ag), the content of bismuth oxide ($Bi_2O_3$) is set to be 20 wt % to 40 wt %, which is higher than the content of bismuth oxide in second dielectric layer 82. Therefore, since the visible light transmittance of first dielectric layer 81 becomes lower than that of second dielectric layer 82, the film thickness of first dielectric layer 81 is set to be thinner than that of second dielectric layer 82.

In second dielectric layer 82, it is not preferable that the content of bismuth oxide ($Bi_2O_3$) is less than 11 wt % because bubbles tend to be generated in second dielectric layer 82 although coloring does not easily occur. Furthermore, it is not preferable that the content of bismuth oxide ($Bi_2O_3$) in first dielectric layer 81 is more than 40 wt % for the purpose of increasing the transmittance because coloring tends to occur.

As the film thickness of dielectric layer 8 is smaller, the effect of improving the panel brightness and reducing the discharge voltage is more remarkable. Therefore, it is desirable that the film thickness is set to be as small as possible within a range in which withstand voltage is not lowered. From such a viewpoint, in the exemplary embodiment of the present invention, the film thickness of dielectric layer 8 is set to be not more than 41 μm, that of first dielectric layer 81 is set to be 5 μm to 15 μm, and that of second dielectric layer 82 is set to be 20 μm to 36 μm.

In the thus manufactured PDP, even when a silver (Ag) material is used for display electrode 6, a coloring phenomenon (yellowing) in front glass substrate 3 is suppressed and bubbles are not generated in dielectric layer 8. Therefore, dielectric layer 8 having excellent withstand voltage performance can be realized.

Next, in the PDP in accordance with the exemplary embodiment of the present invention, the reason why these dielectric materials suppress the generation of yellowing or bubbles in first dielectric layer 81 is considered. It is known that by adding molybdenum oxide ($MoO_3$) or tungsten oxide ($WO_3$) to dielectric glass containing bismuth oxide ($Bi_2O_3$), compounds such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$ are easily generated at such a low temperature as not higher than 580° C. In this exemplary embodiment of the present invention, since the firing temperature of dielectric layer 8 is 550° C. to 590° C., silver ions ($Ag^+$) dispersing in dielectric layer 8 during firing react with molybdenum oxide ($MoO_3$), tungsten oxide ($WO_3$), cerium oxide ($CeO_2$), and manganese oxide ($MnO_2$) in dielectric layer 8 so as to generate a stable compound and are stabilized. That is to say, since silver ions ($Ag^+$) are stabilized without undergoing reduction, they do not aggregate to form a colloid. Consequently, silver ions ($Ag^+$) are stabilized, thereby reducing the generation of oxygen accompanying the colloid formation of silver (Ag). Thus, the generation of bubbles in dielectric layer 8 is reduced.

On the other hand, in order to make these effects be effective, it is preferable that the content of molybdenum oxide ($MoO_3$), tungsten oxide ($WO_3$), cerium oxide ($CeO_2$), and manganese oxide ($MnO_2$) in the dielectric glass containing bismuth oxide ($Bi_2O_3$) is not less than 0.1 wt. %. It is more preferable that the content is not less than 0.1 wt. % and not more than 7 wt. %. In particular, it is not preferable that the content is less than 0.1 wt. % because the effect of suppressing yellowing is reduced. Furthermore, it is not preferable that the content is more than 7 wt. % because coloring occurs in the glass.

As mentioned above, dielectric layer 8 of PDP 1 in accordance with the exemplary embodiment of the present invention contains bismuth oxide and calcium oxide without containing lead. Furthermore, dielectric layer 8 includes first dielectric first dielectric layer 81 covering display electrode 6 and second dielectric layer 82 formed on first dielectric layer 81. It is desirable that the content of bismuth oxide in first dielectric layer 81 and the content of bismuth oxide in second dielectric layer 82 are made to be different from each other. That is to say, it is desirable that a dielectric material of first dielectric layer 81 includes 20 wt. % to 40 wt. % of bismuth oxide ($Bi_2O_3$), and a dielectric material of second dielectric layer 82 includes 11 wt. % to 20 wt. % of bismuth oxide ($Bi_2O_3$). It is desirable that the content of bismuth oxide in second dielectric layer 82 is smaller than the content of bismuth oxide in first dielectric layer 81.

That is to say, in dielectric layer 8 of the PDP in accordance with the exemplary embodiment of the present invention, the generation of yellowing phenomenon and bubbles is suppressed in first dielectric layer 81 that is in contact with metal bus electrodes 4*b* and 5*b* made of a silver (Ag) material. Furthermore, in dielectric layer 8, high light transmittance is realized by second dielectric layer 82 formed on first dielectric layer 81. As a result, it is possible to realize a PDP in which generation of bubbles and yellowing is extremely small and transmittance is high in dielectric layer 8 as a whole.

Next, as the feature of the PDP in accordance with the exemplary embodiment of the present invention, a configuration and a manufacturing method of a protective layer are described.

Figure 3:
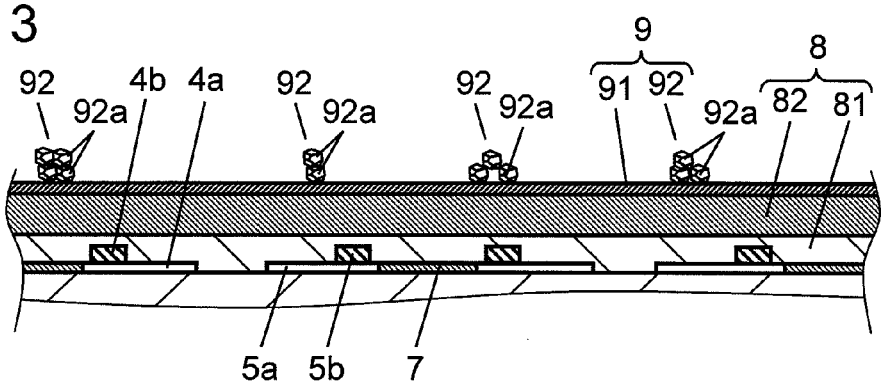
FIG. 3 is an enlarged sectional view showing a protective layer part of the PDP.

The PDP in accordance with the exemplary embodiment of the present invention includes protective layer 9 as shown in FIG. 3. Protective layer 9 includes base film 91 made of MgO containing Al as an impurity on dielectric layer 8. Then, aggregated particles 92 obtained by aggregating several crystal particles 92*a* of MgO as metal oxide are discretely scattered on base film 91. Thus, a plurality of aggregated particles 92 are attached so that they are distributed over the entire surface substantially uniformly, thereby forming protective layer 9. Note here that protective layer 9 on dielectric layer 8 may be formed by forming base film 91 on dielectric layer 8 and attaching a plurality of crystal particles made of metal oxide to the entire surface of base film 91 so that they are distributed over the entire surface.

Figure 4:
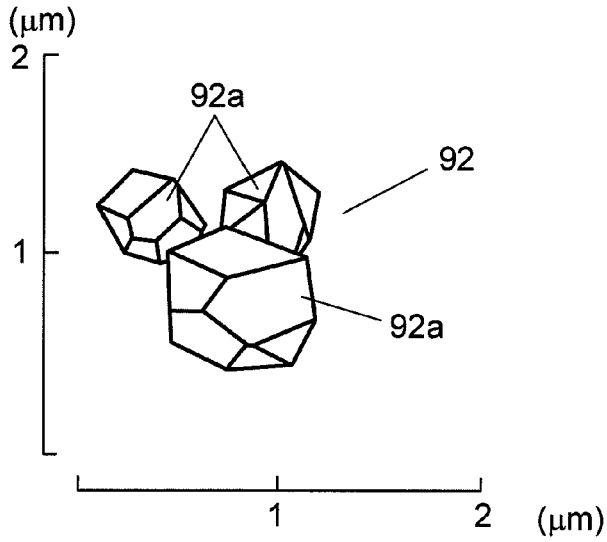
FIG. 4 is an enlarged view illustrating an aggregated particle in the protective layer of the PDP.

Herein, aggregated particle 92 is in a state in which crystal particles 92*a* having a predetermined primary particle diameter are aggregated or necked as shown in FIG. 4. In aggregated particles 92, a plurality of primary particles are not bonded as a solid form with a large bonding strength but they are combined as an assembly structure by static electricity, Van der Waals force, or the like. That is to say, crystal particles 92*a* are combined by an external stimulation such as ultrasonic wave to such a degree that a part or all of crystal particles 92*a* are in a state of primary particles. It is desirable that the particle diameter of aggregated particles 92 is about 1 μm and that crystal particle 92*a* has a shape of polyhedron having seven faces or more, for example, truncated octahedron and dodecahedron.

Furthermore, the primary particle diameter of crystal particle 92*a* of MgO can be controlled by the production condition of crystal particle 92*a*. For example, when crystal particle 92*a* of MgO is produced by firing an MgO precursor such as magnesium carbonate or magnesium hydroxide, the particle diameter can be controlled by controlling the firing temperature or firing atmosphere. In general, the firing temperature can be selected in the range from about 700° C. to about 1500° C. When the firing temperature is set to be a relatively high temperature such as not less than 1000° C., the primary particle diameter can be controlled to be about 0.3 to 2 μm. Furthermore, when crystal particle 92*a* is obtained by heating an MgO precursor, it is possible to obtain aggregated particles 92 in which a plurality of primary particles are combined by aggregation or a phenomenon called necking during production process.

Next, results of experiments carried out for confirming the effect of the PDP including the protective layer in accordance with the exemplary embodiment of the present invention are described.

Figure 5:
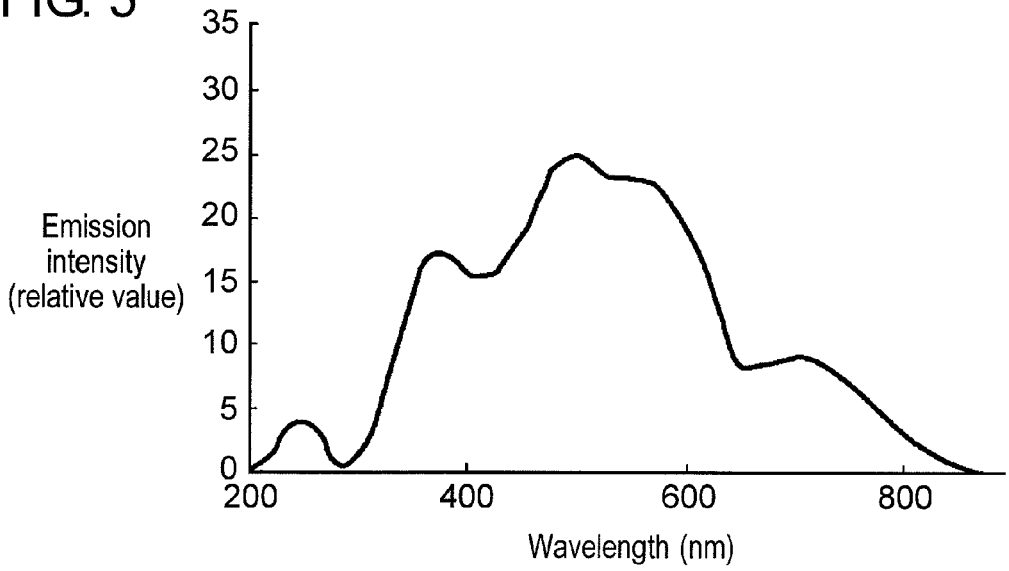
FIG. 5 is a graph showing a measurement result of cathode luminescence of a crystal particle.

Firstly, PDPs including protective layers having different configurations are made as trial products. Trial product 1 is a PDP including only a protective layer made of MgO. Trial product 2 is a PDP including a protective layer made of MgO doped with impurities such as Al and Si. Trial product 3 is a PDP in which only primary particles of crystal particles of metal oxide are scattered and attached to a base film made of MgO. Trial product 4 is a product of the present invention and is a PDP in which aggregated particles obtained by aggregating a plurality of crystal particles are attached to the base film made of MgO so that the aggregated particles are distributed over the entire surface of the base film substantially uniformly as mentioned above. In trial products 3 and 4, as the metal oxide, single-crystal particles of MgO are used. Furthermore, in trial product 4 in accordance with the exemplary embodiment of the present invention, when a cathode luminescence of the crystal particles attached to the base film is measured, trial product 4 has a property of emission intensity with respect to wavelength shown in FIG. 5. The emission intensity is represented by relative values.

PDPs having these four kinds of configurations of protective layers are examined for the electron emission performance and the electric charge retention performance.

As the electron emission performance is represented by a larger value, the amount of electron emission is lager. The electron emission performance is represented by the initial electron emission amount determined by the surface states by discharge, kinds and states of gases. The initial electron emission amount can be measured by a method of measuring the amount of electron current emitted from a surface after the surface is irradiated with ions or electron beams. However, it is difficult to evaluate the front panel surface in a nondestructive way. Therefore, as described in Japanese Patent Unexamined Publication No. 2007-48733, the value called a statistical lag time among lag times at the time of discharge, which is an index showing the discharging tendency, is measured. By integrating the inverse number of the value, a numeric value linearly corresponding to the initial electron emission amount can be calculated. Herein, the thus calculated value is used to evaluate the initial electron emission amount. This lag time at the time of discharge means a time of discharge delay in which discharge is delayed from the rising time of the pulse. The main factor of this discharge delay is thought to be that the initial electron functioning as a trigger is not easily emitted from a protective layer surface toward discharge space at the time when discharge is started.

Furthermore, the electric charge retention performance is represented by using, as its index, a value of a voltage applied to a scan electrode (hereinafter, referred to as "Vscn lighting voltage") necessary to suppress the phenomenon of releasing electric charge when a PDP is produced. That is to say, it is shown that the lower the Vscn lighting voltage is, the higher the electric charge retention performance is. This is advantageous in designing of a panel of a PDP because driving at a low voltage is possible. That is to say, as a power supply or electrical components of a PDP, components having a withstand voltage and a small capacity can be used. In current products, as semiconductor switching elements such as MOSFET for applying a scanning voltage to a panel sequentially, an element having a withstand voltage of about 150 V is used. Therefore, it is desirable that the Vscn lighting voltage is reduced to not more than 120 V with considering the fluctuation due to temperatures.

Figure 6:
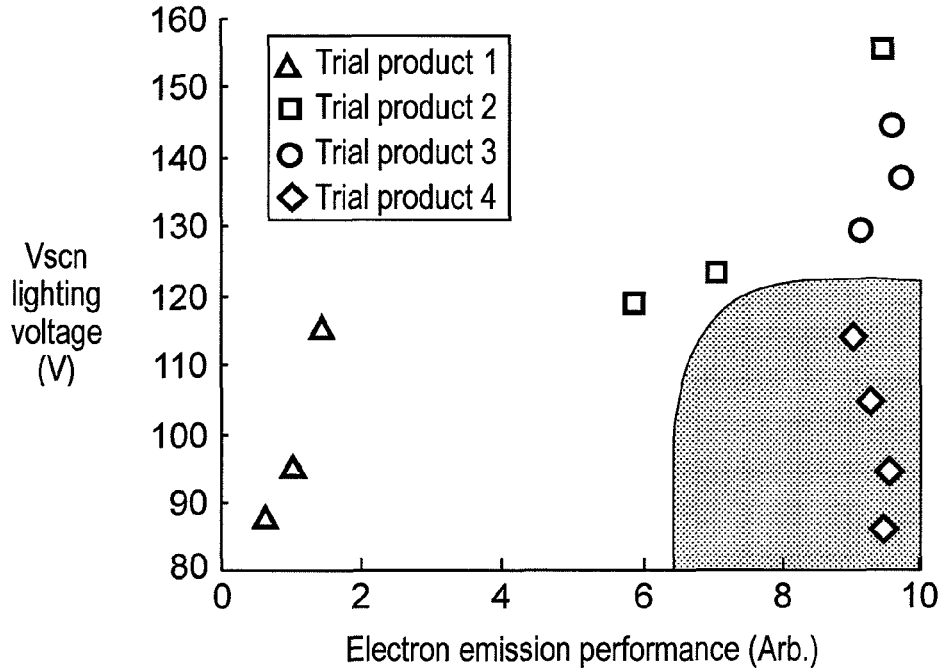
FIG. 6 is a graph showing an examination result of electron emission performance and a Vscn lighting voltage in a PDP in a result of an experiment carried out to illustrate the effect by an exemplary embodiment of the present invention.

Results of examination of the electron emission performance and the electric charge retention performance are shown in FIG. 6. As is apparent from FIG. 6, trial product 4 can achieve excellent performance: the Vscn lighting voltage can be not more than 120 V in the evaluation of the electric charge retention performance, and the electron emission performance is not less than 6.

In general, the electron emission performance and the electric charge retention performance of a protective layer of a PDP conflict with each other. The electron emission performance can be improved, for example, by changing the film formation condition of the protective layer or by forming a film by doping the protective layer with impurities such as Al, Si, and Ba. However, the Vscn lighting voltage is also increased as a side effect.

In a PDP including a protective layer in accordance with the exemplary embodiment of the present invention, the electron emission performance of not less than 6 and the Vscn lighting voltage as the electric charge retention performance of not more than 120 V can be achieved. Consequently, in a protective layer of a PDP in which the number of scan lines tends to increase and the cell size tends to be smaller according to high definition, both the electron emission performance and the electric charge retention performance can be satisfied.

Next, the particle diameter of crystal particle used in the protective layer of the PDP in accordance with the exemplary embodiment is described. In the description below, the particle diameter denotes an average particle diameter, i.e., a volume cumulative mean diameter (D50).

Figure 7:
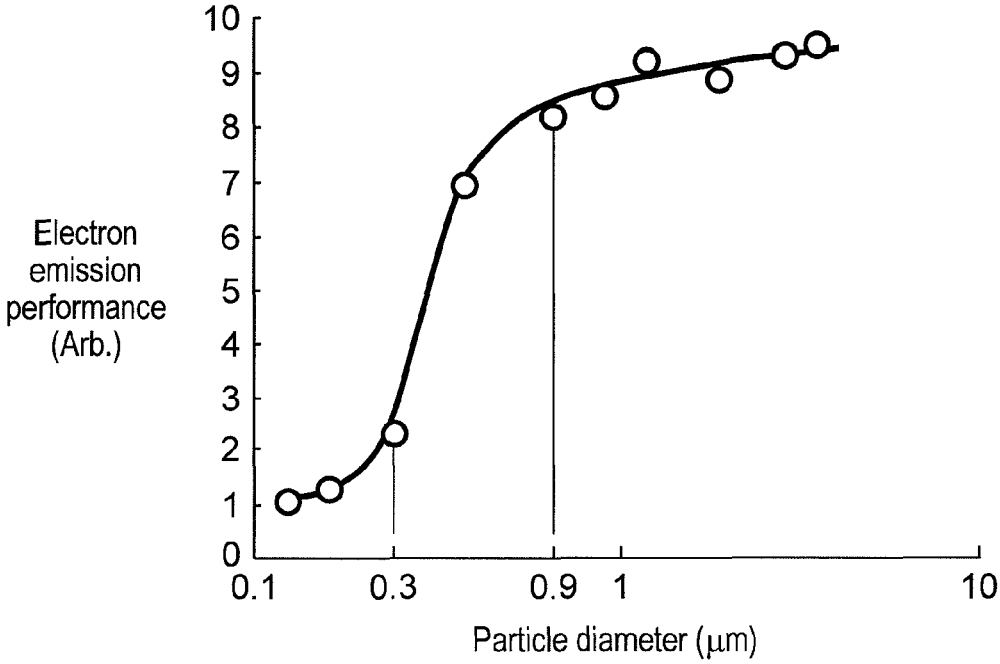
FIG. 7 is a graph showing a relation between a particle diameter of a crystal particle and electron emission performance.

FIG. 7 shows a result of an experiment for examining the electron emission performance by changing the particle diameter of MgO crystal particle in trial product 4 in accordance with the exemplary embodiment described with reference to FIG. 6 above. In FIG. 7, the particle diameter of MgO crystal particle is measured by SEM observation of crystal particles.

FIG. 7 shows that when the particle diameter is as small as about 0.3 μm, the electron emission performance is reduced, and that when the particle diameter is substantially not less than 0.9 μm, high electron emission performance can be obtained.

In order to increase the number of emitted electrons in the discharge cell, it is desirable that the number of crystal particles per unit area on the base film is large. According to the experiment carried out by the present inventors, when crystal particles exist in a portion corresponding to the top portion of the barrier rib on the rear panel that is in close contact with the protective layer of the front panel, the top portion of the barrier rib may be damaged. As a result, it is shown that the material may be put on a phosphor, causing a phenomenon that the corresponding cell is not normally lighted. The phenomenon that a barrier rib is damaged does not easily occur if crystal particles do not exist on the top portion corresponding to the barrier rib. Therefore, when the number of crystal particles to be attached increases, the rate of occurrence of the damage of the barrier rib increases.

Figure 8:
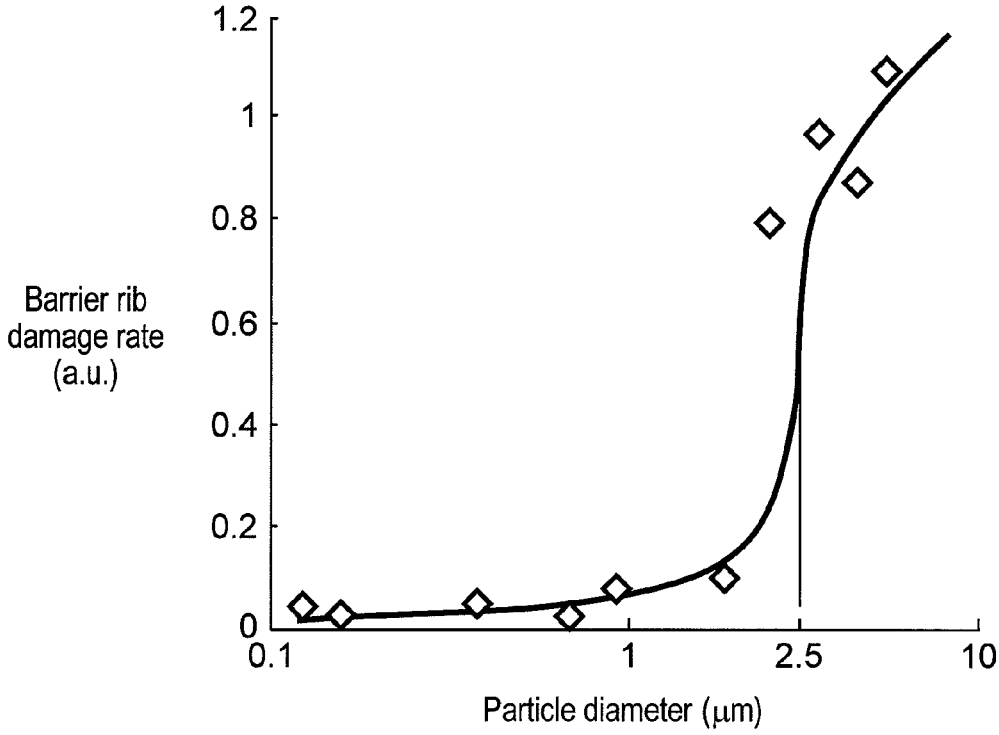
FIG. 8 is a graph showing a relation between a particle diameter of a crystal particle and the occurrence rate of damage of a barrier rib.

FIG. 8 is a graph showing a result of an experiment for examining a relation between the particle diameter and the damage of the barrier rib when the same number of crystal particles having different particle diameters are scattered in a unit area in trial product 4 in accordance with the exemplary embodiment described with reference to FIG. 6 above.

As is apparent from FIG. 8, when the crystal particle diameter is as large as about 2.5 μm, the probability of damage of the barrier rib rapidly increases. However, when the crystal particle diameter is less than 2.5 μm, the probability of damage of the barrier rib can be reduced to relatively small.

Based on the above results, it is thought to be desirable that crystal particles have a particle diameter of not less than 0.9 μm and not more than 2.5 μm in the protective layer of the PDP in accordance with the exemplary embodiment. However, in actual mass production of PDPs, variation of crystal particles in manufacturing or variation in manufacturing when a protective layer is formed needs to be considered.

Figure 9:
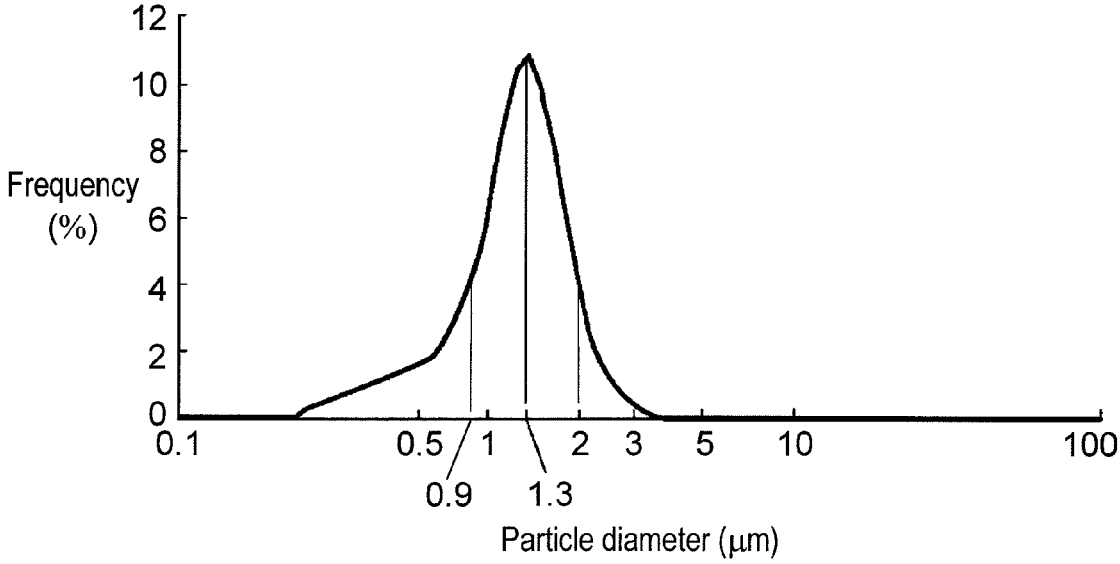
FIG. 9 is a graph showing an example of the particle size distribution of crystal particles in a PDP in accordance with an exemplary embodiment of the present invention.

In order to consider the factors of variation in manufacturing and the like, an experiment using crystal particles having different particle size distributions is carried out. FIG. 9 is a graph showing one example of the particle size distribution of the crystal particles in the PDP in accordance with the exemplary embodiment of the present invention. The frequency (%) in the ordinate shows a rate (%) of the amount of crystal particles existing in each of divided ranges of particle diameters shown in the abscissas with respect to the total amount of crystal particles. As a result of the experiment, as shown in FIG. 9, it is preferable to use of crystal particles having the average particle diameter of not less than 0.9 μm and not more than 2 μm because the above-mentioned effect of the invention can be obtained stably.

As mentioned above, in the PDP including the protective layer in accordance with the exemplary embodiment of the present invention, the electron emission performance of not less than 6 and the Vscn lighting voltage as the electric charge retention performance of not more than 120 V can be achieved. That is to say, in a protective layer of a PDP in which the number of scanning lines tends to increase and the cell size tends to be smaller according to the high definition, both the electron emission performance and the electric charge retention performance can be satisfied. Thus, a PDP having a high definition and high brightness display performance and also having low electric power consumption can be realized.

Next, manufacturing steps of forming a protective layer in a PDP in accordance with the exemplary embodiment are described with reference to FIG. 10.

Figure 10:
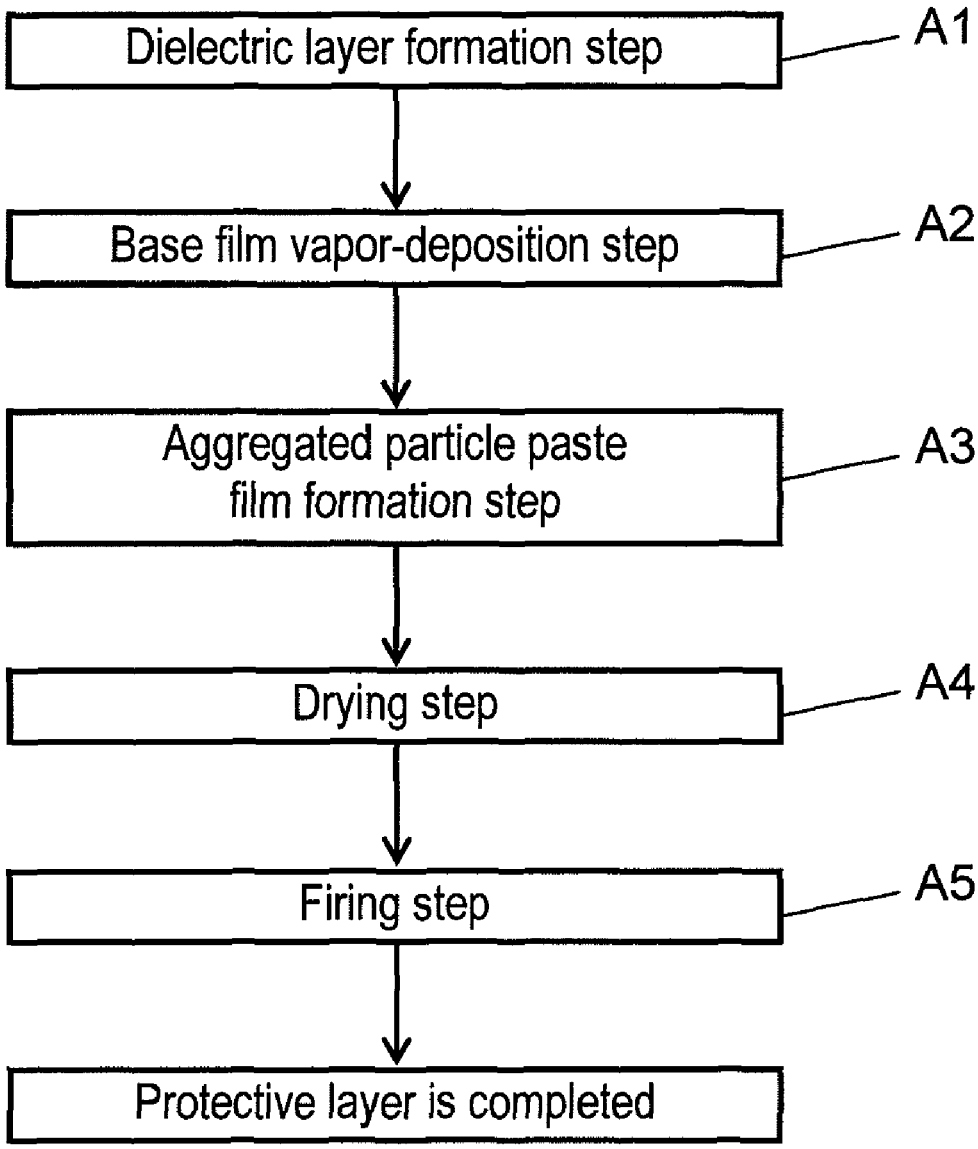
FIG. 10 is a flow chart showing the steps of forming a protective layer in a method of manufacturing a PDP in accordance with an exemplary embodiment of the present invention.

As shown in FIG. 10, dielectric layer formation step A1 of forming dielectric layer 8 including a laminated structure composed of first dielectric layer 81 and second dielectric layer 82 is carried out. Then, in the following base film vapor-deposition step A2, a base film made of MgO is formed on second dielectric layer 82 of dielectric layer 8 by a vacuum-vapor-deposition method using a sintered body of MgO containing aluminum (Al) as a raw material.

Then, aggregated particle paste film formation step A3 of discretely attaching a plurality of aggregated particles to a non-fired base film formed in base film vapor-deposition step A2 is carried out.

In step A3, firstly, an aggregated particle paste obtained by mixing aggregated particles 92 having a predetermined particle size distribution together with a resin component into a solvent is prepared. The aggregated particle paste is coated on the non-fired base film by a printing method such as a screen printing method so as to form an aggregated particle paste film. An example of methods of coating the aggregated particle paste on the non-fired base film so as to form an aggregated particle paste film may include a spray method, a spin-coat method, a die coating method, a slit coat method, and the like, in addition to the screen printing method.

After the aggregated particle paste film is formed, drying step A4 of drying the aggregated particle paste film is carried out.

Thereafter, the non-fired base film formed in base film vapor-deposition step A2 and the aggregated particle paste film formed in aggregated particle paste film formation step A3 and subjected to drying step A4 are fired simultaneously at a temperature of several hundred degrees in firing step A5. In firing step A5, the solvent or resin components remaining in the aggregated particle paste film are removed, so that protective layer 9 in which aggregated particles 92 obtained by aggregating a plurality of metal oxide crystal particles 92*a* are attached to base film 91 can be formed.

With this method, a plurality of aggregated particles 92 can be attached to base film 91 so that they are distributed over the entire surface substantially uniformly.

In addition to such a method, a method of directly spraying a particle group together with gas without using a solvent or a scattering method by simply using gravity may be used.

In the above description, as a protective layer, MgO is used as an example. However, performance required by the base is high sputter resistance performance for protecting a dielectric layer from ion bombardment, and electron emission performance may not be so high. In most of conventional PDPs, a protective layer containing MgO as a main component is formed in order to obtain predetermined level or more of electron emission performance and sputter resistance performance. However, for achieving a configuration in which the electron emission performance is mainly controlled by metal oxide single-crystal particles, MgO is not necessarily used. Other materials such as $Al_2O_3$ having an excellent shock resistance property may be used.

In this embodiment, MgO particles are used as single-crystal particles, but the other single-crystal particles may be used. The same effect can be obtained when other single-crystal particles of oxide of metal such as Sr, Ca, Ba, and Al having high electron emission performance similar to MgO are used. Therefore, the kinds of particles are not limited to MgO.

INDUSTRIAL APPLICABILITY

As mentioned above, the present invention is useful in realizing a PDP having high definition and high brightness display performance and low electric power consumption.

The invention claimed is:

1. A plasma display panel comprising:

a front panel including:

a substrate;

a display electrode formed on the substrate;

a dielectric layer formed so as to cover the display electrode; and a protective layer formed on the dielectric layer; and a rear panel being disposed facing the front panel so that discharge space is formed and including an address electrode formed in a direction intersecting the display electrode, and a barrier rib for partitioning the discharge space, wherein the dielectric layer of the front panel contains bismuth oxide and calcium oxide without containing lead, and the protective layer is formed by forming a base film on the dielectric layer and attaching a plurality of crystal particles made of metal oxide to the base film so as to be distributed over an entire surface of the base film.

2. The plasma display panel of claim 1, wherein the crystal particle has an average particle diameter of not less than 0.9 μm and not more than 2 μm.

3. The plasma display panel of claim 1, wherein the dielectric layer includes:

a first dielectric layer covering the display electrode, and a second dielectric layer formed on the first dielectric layer, wherein a content of bismuth oxide in the second dielectric layer is made to be different from a content of bismuth oxide in the first dielectric layer.

* * * * *